United States Patent [19]

Sturman et al.

[11] Patent Number: 5,022,565

[45] Date of Patent: Jun. 11, 1991

[54] SOFT DRINK DISPENSER

[75] Inventors: Oded E. Sturman, Newbure Park; Benjamin Grill, Northridge; Walter L. Harrison, Newhall, all of Calif.

[73] Assignee: Kineret Engineering, Newhall, Calif.

[21] Appl. No.: 473,099

[22] Filed: Jan. 31, 1990

Related U.S. Application Data

[63] Continuation of Ser. No. 209,879, Jun. 22, 1988, abandoned.

[51] Int. Cl.[5] ..... B65D 83/00

[52] U.S. Cl. ..... 222/396; 222/5; 222/397; 222/399; 222/464; 222/517

[58] Field of Search ..... 222/3, 5, 394, 396, 222/397, 399, 400.7, 464, 511, 517

[56] References Cited

U.S. PATENT DOCUMENTS

| | | | |
|---|---|---|---|
| 1,234,939 | 7/1917 | Schmid | 222/399 X |
| 1,957,854 | 5/1934 | Smith | 222/399 X |
| 2,388,026 | 10/1945 | Ward | 222/396 X |
| 3,039,661 | 6/1962 | Wentz et al. | 222/396 |
| 3,065,883 | 11/1962 | Nelson | 222/399 X |
| 3,195,788 | 7/1965 | Wilson | 222/399 |
| 3,197,144 | 7/1965 | Kochner | 222/399 X |
| 3,243,085 | 3/1966 | Wilson | 222/399 X |
| 3,307,751 | 3/1967 | Kraft | 222/464 |
| 3,315,844 | 4/1967 | Klasson et al. | 222/399 X |
| 3,319,829 | 5/1967 | Sentz | 222/5 |
| 3,452,902 | 7/1969 | Cornelius | 222/399 X |
| 3,469,745 | 9/1969 | Serio, Jr. et al. | 222/399 |
| 3,558,010 | 1/1971 | Zenger et al. | 222/394 X |
| 3,679,104 | 7/1972 | Giroud | 222/396 |
| 3,998,364 | 12/1976 | Hollander | 222/394 X |
| 4,186,848 | 2/1980 | Walter | 222/184 X |
| 4,694,975 | 9/1987 | Hagan | 222/464 X |

*Primary Examiner*—Kevin P. Shaver

*Attorney, Agent, or Firm*—Blakely, Sokoloff, Taylor & Zafman

[57] ABSTRACT

A portable dispenser for fastening to a conventional carbonated beverage container and providing the convenient dispensing of the contents therein while maintaining the carbonation of the beverage until fully consumed is disclosed. The dispenser is comprised of a body assembly for threadedly engaging a conventional carbonated beverage container, such as one liter, two liter and three liter PET containers, and sealing with respect thereto. The body assembly contains a tube assembly for extending from the bottom of the beverage within the container to the dispenser outlet, with a valve mechanism spring loaded to squeeze the tube closed and manually operable for controllably allowing the flow of the beverage therethrough. The body assembly includes a unique pressure regulator and a $CO_2$ cartridge in a cartridge holder for providing a source of $CO_2$ at the regulated pressure to the beverage container.

7 Claims, 3 Drawing Sheets

VALVES CLOSED

VALVES OPEN

SOFT DRINK DISPENSER

This is a continuation of application Ser. No. 07/209,879 filed June 22, 1988, now abandoned.

BACKGROUND OF THE INVENTION

1. Field of the Invention

The present invention relates to the field of soft drink dispensers and more particularly, pre-mixed soft drink dispensers.

2. Prior Art

In recent years increasing quantities of carbonated soft drinks have been sold for home consumption in larger and larger containers, as opposed to the smaller cans and bottles containing individual servings. At the present time, a large amount of soft drink is sold in two liter PET bottles for home consumption. Such bottles are light and disposable and do not present a safety problem if dropped, etc. However, the repeated opening of such bottles for individual servings from time to time allows most of the carbon dioxide to escape, resulting in a substantial portion of the soft drink going flat before it is consumed.

To avoid this problem on these and other carbonated beverage containers, various devices have been proposed for mounting to the top of a bottle for maintaining carbon dioxide pressure on the soft drink at all times, and for dispensing the same when desired. By way of example, Belgian Patent No. 743485 discloses a device which has a dispensing valve in the soft drink outlet, and a separate carbon dioxide valve for adding more carbon dioxide to the container when the pressure therein drops more than desired. In Austrian Patent No. 144111, a pressure regulator is used to control the carbon dioxide pressure on the soft drink. See also U.S. Pat. No. 3,976,221 for another form of pressure regulator for that purpose.

In the dispensing of highly carbonated soft drinks, foaming frequently is a very serious problem. The extent of foaming that one obtains will vary with the circumstances and the dispensing devices used, though in any event foaming is an undesirable occurrence, as the foaming makes it difficult to fill a serving glass, and of course the foam represents the escape of the previously dissolved carbon dioxide from the soft drink, resulting in a flat drink remaining after the foam subsides. Thus, most carbonated soft drink dispensing equipment is designed with this problem in mind. In that regard, see for instance the two balls in the soft drink dispensing line in U.S. Pat. No. 3,976,221. In some instances, foaming is caused by the carbonated soft drink squirting out through small openings at high velocity, such as a small and/or sharp edged mechanical valve of some kind. Techniques to avoid this include such things as the use of the two small balls, wherein normal viscous effects will at least somewhat limit the velocity of the carbonated soft drink through the small gap between the balls and the tubular member in which they are mounted.

In other instances however, such as in the case of excessive carbonation, at least for the then current temperature of the carbonated soft drink, some substantial release of carbon dioxide is inevitable when the pressure on the carbonated soft drink is reduced to atmospheric pressure, no matter how gently this is accomplished. By way of specific example, if one opens a new bottle of carbonated soft drink at room temperature without the slightest shaking thereof, the soft drink will still initially bubble quite furiously, as the soft drink contains considerably more dissolved carbon dioxide than the liquid can maintain under atmospheric pressure. Trying to dispense a soft drink which is substantially over-carbonated for its current temperature will result in a great deal of foaming, and the use of some form of flow restrictor, even if to accumulate viscous losses, will only aggravate the foaming problem, as foaming occurring in the dispensing passage only serves to tend to choke off the same, causing the squirting of the liquid soft drink to do an even more complete job of separating the carbon dioxide therefrom.

The purpose of the present invention is to provide a particularly low cost, pressure regulated soft drink dispenser having a particularly simple and unique pressure regulator therein, and having a dispensing system which will minimize foaming under substantially all conditions, yet which will open in the event of excess pressure to avoid bursting of the soft drink container due to a failure of the pressure regulator to completely shut-off for some reason and/or failure of the primary pressure relief valve for some reason.

BRIEF SUMMARY OF THE INVENTION

A portable dispenser for fastening to a conventional carbonated beverage container and providing the convenient dispensing of the contents therein while maintaining the carbonation of the beverage until fully consumed is disclosed. The dispenser is comprised of a body assembly for threadedly engaging a conventional carbonated beverage container, such as one liter, two liter and three liter PET containers, and sealing with respect thereto. The body assembly contains a tube assembly for extending from the bottom of the beverage within the container to the dispenser outlet, with a valve mechanism spring loaded to squeeze the tube closed and manually operable for controllably allowing the flow of the beverage therethrough. The body assembly includes a unique pressure regulator and a $CO_2$ cartridge in a cartridge holder for providing a source of $CO_2$ at the regulated pressure to the beverage container.

DETAILED DESCRIPTION OF THE INVENTION

Figure 1:
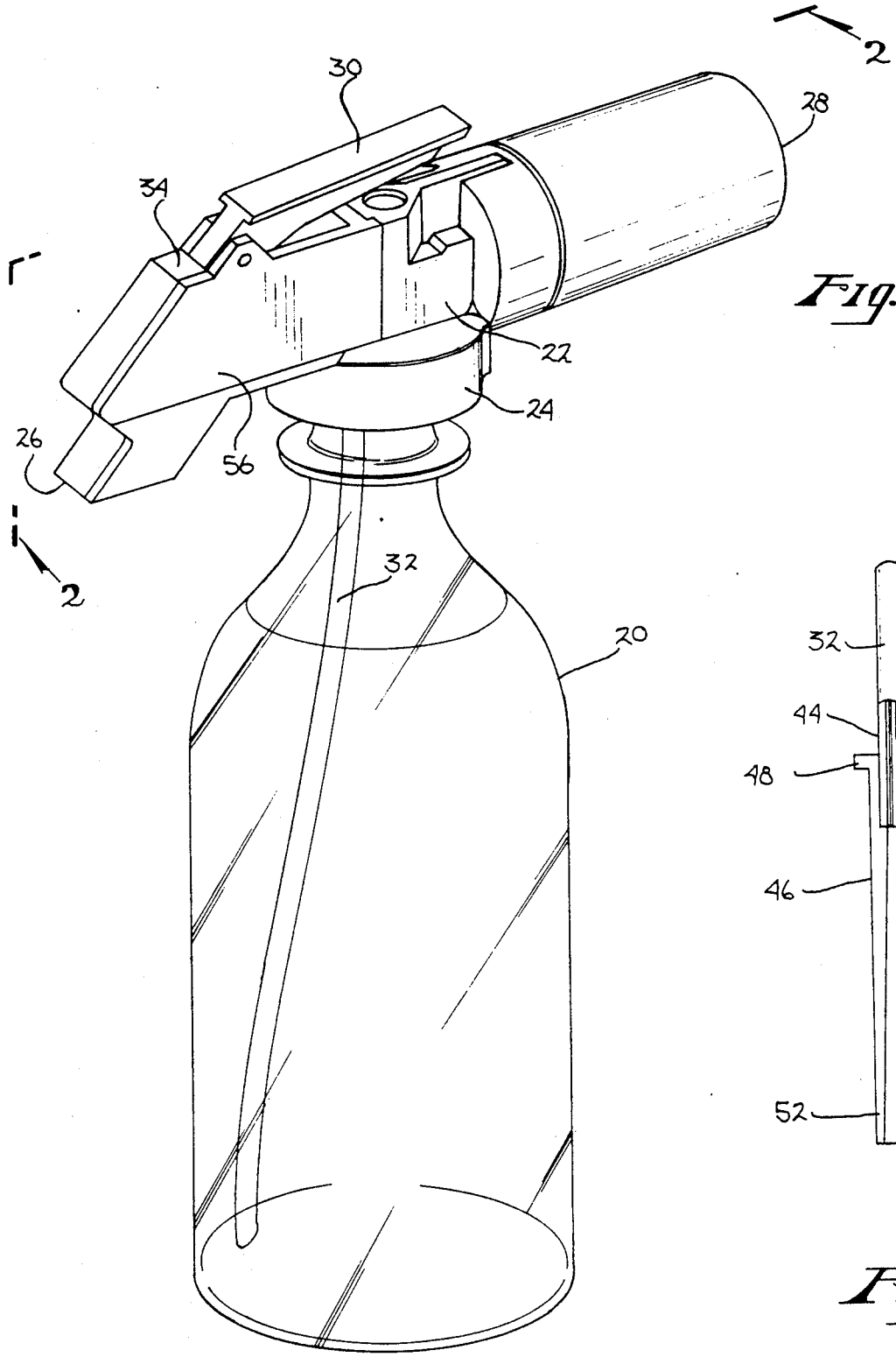
FIG. 1 is a perspective view of the present invention.

First referring to FIG. 1, a perspective view of the present invention as mounted to a two liter PET carbonated soft drink bottle 20 may be seen. The dispenser of the present invention is generally characterized by a body assembly 22 having a lower portion 24 which screws onto the top of the soft drink bottle, a forward lower portion 26 forming a dispensing spout, an aft portion 28 for containing a small carbon dioxide cartridge and a dispensing lever 30 for controllably dispensing the soft drink through a tube in the spout 26. Also coupled to the body of the assembly 22 is a flexible tube 32 which extends into the bottle 20 to a position adjacent the bottom thereof so as to allow the operation of the dispenser with the bottle in the upright position.

Figure 4:
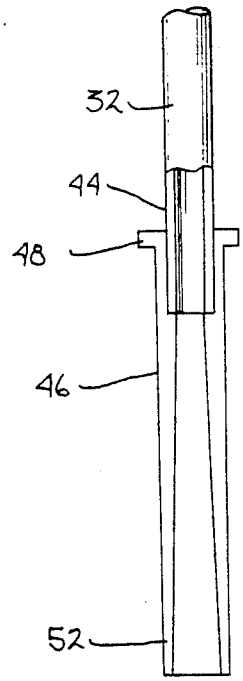
FIG. 4 is a partial cross-section of the dispensing tube assembly of the present invention.
Figures 2, 3:
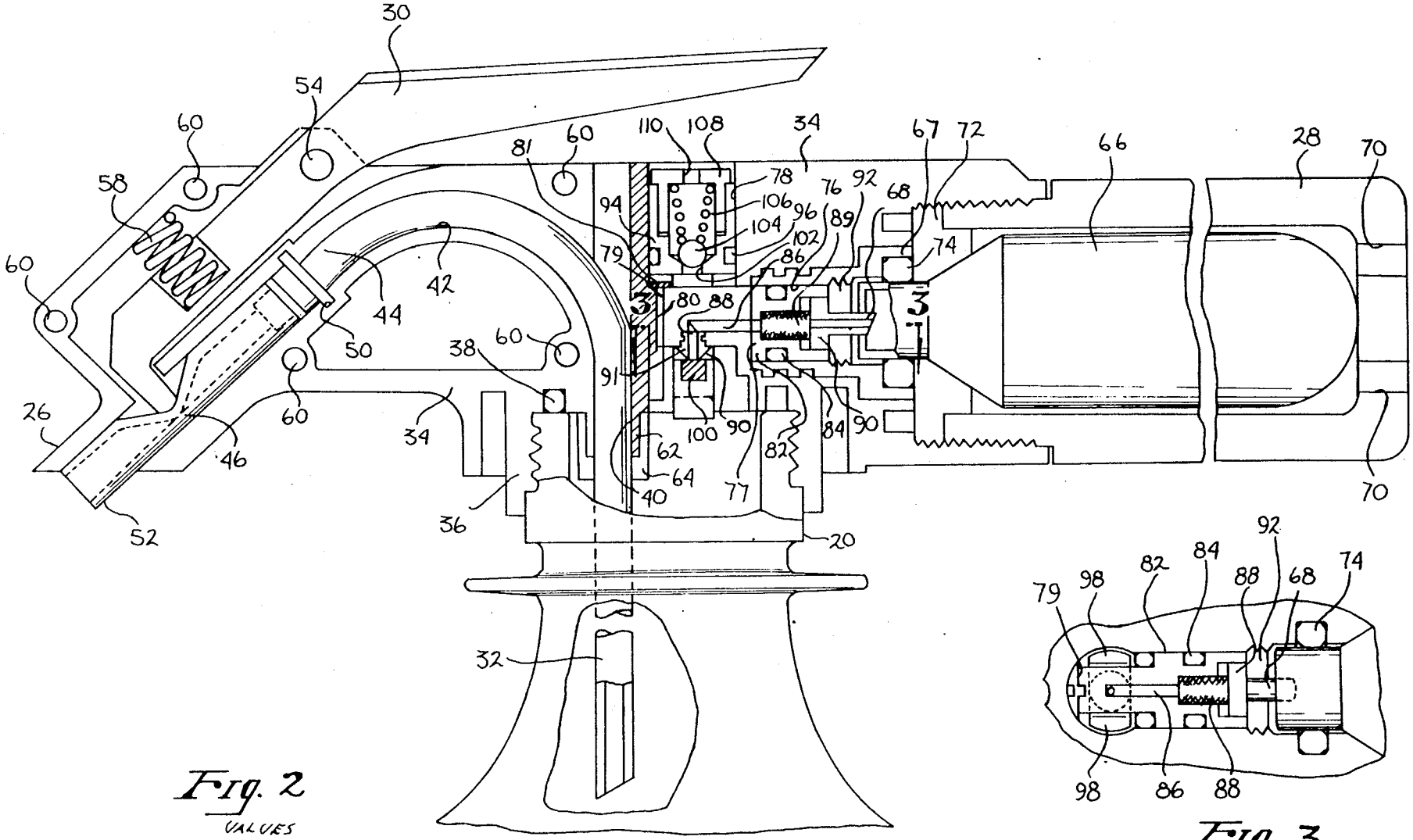
FIG. 2 is a partial cross-section taken along line 2—2 of FIG. 1.
FIG. 3 is a partial cross-section taken along line 3—3 of FIG. 2.

FIG. 2 is a partial cross-section of the dispenser taken along line 2—2 of FIG. 1. The body assembly 22 of FIG. 1 is comprised of a body member 34 which provides the primary structure for the dispenser. As shown in FIG. 2, body member 34 includes an integral internally threaded downward protrusion 36 for screwing onto the bottle, with a seal member 38 in a depression at the top thereof providing the ultimate seal with the top of the PET bottle. The tube 32 (see also FIG. 1), a polyethylene tube in the preferred embodiment, passes through a hole 40 in the body member at the top of the bottle 20 to proceed upward therefrom and curve toward the spout region 26 in a groove 42 in the body member. The end 44 of the tube 32 extends into a silicone rubber member 46 (see also FIG. 4) resting in a continuation of the groove 42 and extending downward to a position approximately flush with the end of the spout-like projection 26 of the body member, the silicone rubber projection 46 having a flange 48 therein resting in a complimentary groove 50 in the body member for positive location thereof. In the preferred embodiment the polyethylene tube 32 has an inner diameter of 0.078, with the silicone rubber member 46 pushing over the end thereof to define a smooth continuation of the passage defined by the inner diameter of the polyethylene tube 32 by way of a passage flairing or tapering outward to the distal end 52 thereof, having an inner diameter of 0.156 at the outlet end thereof. While the flare can vary from the value given providing the rate of change of area is gradual, and in fact satisfactory operation is obtained with no flare, the inner diameter of the tube 32 is more critical. In particular, if the inner diameter of the tube is much larger, the flow velocity will be too high and unnecessary foaming will occur in the container being dispensed into. Also, the volumetric flow rate will be too high, tending to cause a user to throttle the output with the valve, causing the soft drink to squirt and triggering excessive foaming where the dispensing tube is partially pinched. On the other hand, if the diameter of tube 22 is much smaller, not only will the volumetric flow rate be tediously slow, but the transit time of the soft drink in the dispensing tube will be so long that unpreventable foaming due to over carbonation will more fully develop therein, which because of the restricted flow area can trigger additional unnecessary foaming. Consequently, while the 0.078 diameter is preferred, a diameter within approximately 10% thereof is generally acceptable, with a diameter of more than approximately 20% thereof exceeding any normally acceptable range.

This configuration, as shall subsequently be seen, comprises an important aspect of the present invention, as it provides a very simple yet effective solution to the foaming problem, and at the same time provides a very low cost dispensing valve which may also act as a relief valve in the event of failure both of the pressure regulator and the primary relief valve, yet to be described. In particular, the dispensing lever 30, supported on integral pivot pins 54 from the body member 34 on one side and the cover plate 56 (see FIG. 1) on the other side, is encouraged by compression spring 58 against the silicone rubber member 46 to squeeze off the same to prevent the passage of any soft drink thereby and out the outlet under normal operating pressures within the soft drink container, though to essentially blow open to vent the system in the event the pressure substantially exceeds the normal operating pressure of the system.

Figures 5, 6:
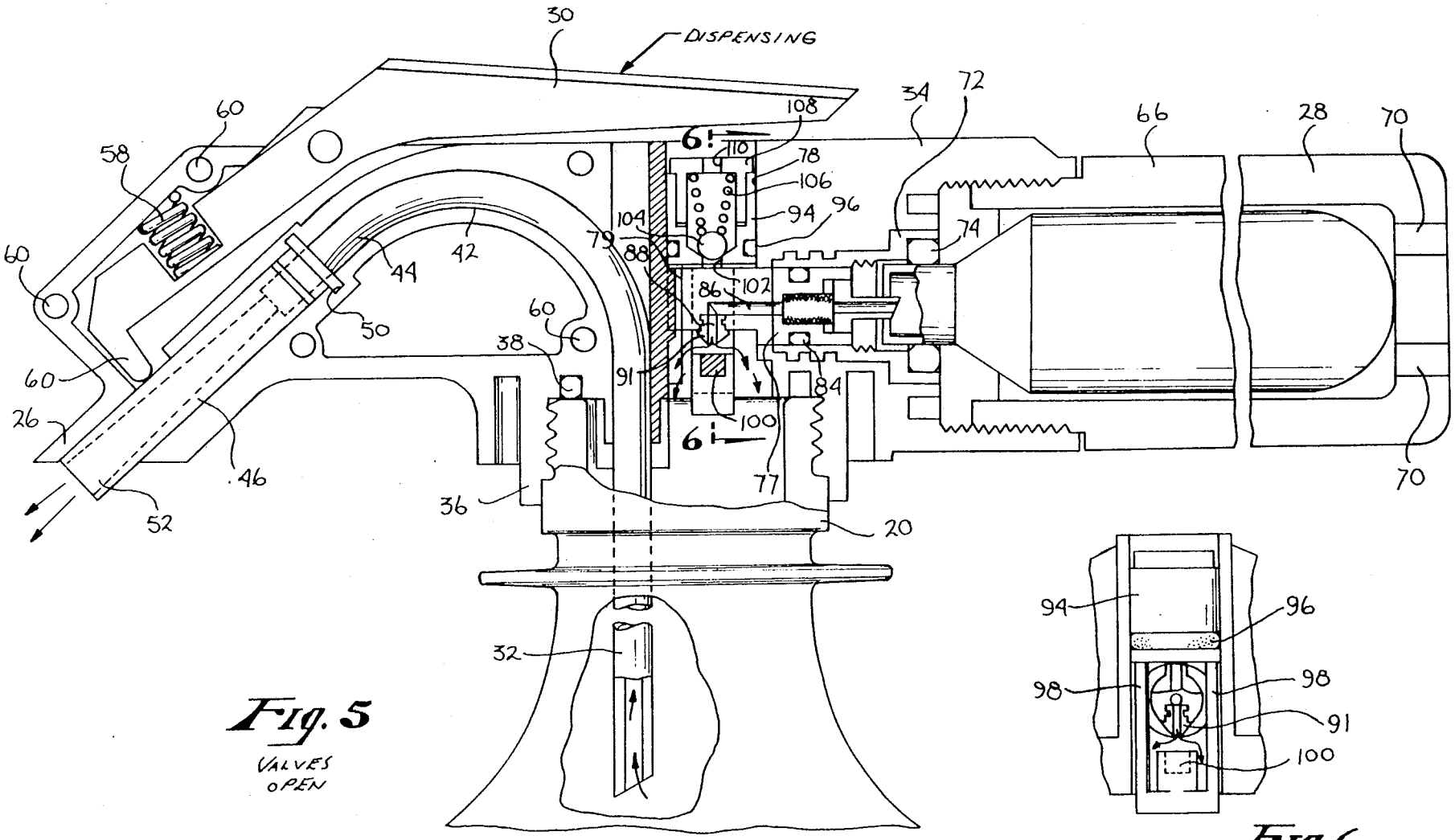
FIG. 5 is a partial cross-section similar to FIG. 2 but illustrating the relationship of the various parts with the dispensing valve as well as the carbon dioxide regulator valve open.
FIG. 6 is a partial cross-section taken along line 6—6 of FIG. 5.

In FIG. 5, the dispensing lever 30 is shown in a depressed position, effectively opening the dispensing valve all the way to allow the dispensing of the carbonated soft drink as a result of the pressure which is maintained on the carbonated soft drink therein. It will be noted that the valve is shown fully opened, that is, the end 60 of the dispensing lever 30 has been raised so as to no longer pinch the silicone rubber section 46 to allow the same to open fully. In that regard, the valve is intended to be either fully closed or fully opened, and not to be used to throttle the rate of dispensing by being partially open, as it is just such throttling action which induces the undesired foaming. Instead, the inner diameter of tube 32 has been carefully selected to provide sufficient viscous forces on the carbonated soft drink flowing therethrough during dispensing to limit the velocity thereof to a reasonable value, which velocity will further decrease in member 46 because of the increasing cross-sectional area of the flow path therein, to be dispensed at a velocity which is sufficiently limited to avoid substantial separation of the carbon dioxide therefrom when the stream intercepts the wall of the container it is being dispensed into, or collides with the carbonated soft drink already collected in the container. Still the flow velocity in the tube 32 is sufficiently fast so that if there is some over carbonation in the carbonated soft drink in the container 20, the carbonated soft drink will pass through tube 32 and outlet section 46 before significant separation of the carbon dioxide from the carbonated soft drink can occur due to the reducing pressure thereon. While such over-carbonation will necessarily result in some foaming or a head on the carbonated soft drink in the glass, this amount of foaming or head would occur even if the soft drink had been poured from a freshly opened bottle. Finally, the volume rate of flow of the soft drink during dispensing is also sufficiently low to avoid one's trying to further reduce the rate of flow by partial closing of the dispensing valve.

The avoidance of significant separation of the carbon dioxide from the carbonated soft drink in the dispensing tube is particularly important, as significant carbon dioxide separation therein will only cause higher velocities in the dispensing tube, as well as the blowing action causing even greater separation of the carbon dioxide from the soft drink. This is an important feature of the present invention, as the net result is the ability to dispense a carbonated soft drink having the proper level of carbonation for its temperature without significant separation of carbon dioxide therefrom, combined with the capability of dispensing a soft drink which is over-carbonated for its current temperature without foaming significantly beyond what would be encountered by merely pouring the same carbonated soft drink into a glass, all with a minimum cost structure also serving as a pressure relief valve.

Referring again to FIGS. 1 and 2, the forward portion of the body member 34 containing the groove 42 for tube 32, the groove for silicone rubber member 46 and the cavity for coil spring 58, and the enclosed portion of dispensing lever 30 is enclosed by cover plate 56 having pins on the inner surface thereof for press fitting into holes 60 in the body member 34 for permanent retention thereof. The cover plate 56 defines one pivot point, with the body member 34 defining the opposite pivot point for the protrusions 54 on the dispensing lever 30 (see FIG. 2) to define the axis of rotation thereof. Below the cover plate 56 containing the proportion which screws onto the top of the soft drink bottle and aft of the cover plate, the body member is ported etc., as required for the various assemblies therein. By way of example, tube 32 (see FIG. 2) extends upward through a tubular extension 62 (see FIG. 2) of the body member and through a hole therein before extending upward into the groove thereabove that is covered by the cover plate 56. This downward protrusion 62 and a short portion of tube 32 has a silicone rubber member 64 thereon to provide a seal around the tube. The silicone rubber member 64 has a relatively tight fit on the tube as well as the tubular projection 62 to provide the desired seal, with pressure in the soft drink bottle merely increasing the sealing effect thereof.

At the back of body member 34 is a screw-on cap 28 for containing a conventional small carbon dioxide container 66, and forcing the same against a hollow piercing pin 68 in the body member. The screw-on cap 28 is ribbed on the inside and vented by holes 70 at the back thereof to prevent the cap from ever becoming pressurized for any reason whatsoever. Forward of the cap 28 is a threaded member 72 retained on the continuation of the same threads in body member 34 as the cap 28, the member 72 retaining an o-ring 74 for providing a seal between the body member 34 and the forward portion of the carbon dioxide container 66 aft of the piercing member 68.

Generally in this aft portion of the body 34 are two holes or openings 76 and 78, the opening 76 being horizontal and coaxial with the carbon dioxide container 66 defined in part by a molded in nickel plated brass insert 67, and the opening 78 being perpendicular thereto extending vertically through the top wall of the body member 34 and through the bottom wall thereof for communication with the interior of a soft drink bottle coupled thereto. Both openings are generally cylindrical openings, though opening 76 has a pair of opposed side ribs 77 interrupting the round cross section of the opening, and region 79 is stepped inward to thicken the local wall of the opening, with a vertical tab 80 and an upper horizontal flange 81 thereon, the function of which shall subsequently be described.

Positioned in opening 76 is a first regulator member 82 sealed with respect to the opening 76 by an o-ring 84, and having intersecting horizontal and vertical openings 86 and 88 therethrough communicating with a small valve seat 90 centered within opening 78 and projecting straight downward toward the bottle, the valve seat 90 being defined by a small nickel plated brass molded in insert 91. The first valve member 82 is retained in the desired angular orientation by the engagement of the rectangular protrusion or tab 80 with a cooperatively disposed slot in the end of the first valve member 82, and is restrained from deflecting upward by flange 81 in opening 78. Positioned within an enlarged area of opening 86 in the first valve member 82 and retained in that position by the flange 90 on the puncture pin 68 is a sintered metal member 89 which prevents any metal particles released during the piercing of a carbon dioxide cartridge by the puncture pin 68 from getting into the soft drink bottle, the same being held in position by a lock nut 92 forcing the assembly together, member 82 being restricted from movement by engagement of the same by side ribs 77 in opening 76 (see FIG. 3) and the engagement of the distal end thereof with region 79 of opening 78. These various parts may also be seen in FIG. 3 which is a section taken along line 3—3 of FIG. 2.

The remaining pressure regulator structure may be seen in a combination of FIGS. 2, 3, 5 and 6, though because certain details are viewable only in certain figures, specific attention will be directed to specific figures in the description to follow. As may be best seen in FIGS. 2, 5 and 6, a second valve member 94 is positioned within the vertical opening 78, being moveable therein though sealed with respect to the opening by an o-ring 96. The second valve member 94, the body of which is positioned above the first valve member 82 (FIGS. 2 and 5) has integral therewith a pair of arms 98 (FIGS. 3 and 6) which extend past the side of the portion of the first valve member 82 extending into the intercepting openings 76 and 78 to support a valve closure member 100 under the valve seat 90 (FIGS. 2, 5 and 6). The upper portion of member 94 is hollow having an opening 102 through the center thereof, with a ball 104 being encouraged against the opening to seal the same by compression spring 106 retained in position by a cap member 108 press-fit into member 94, cap member in turn having an opening 110 through the top thereof.

Thus, with the foregoing configuration, there are three primary vertical forces on this second valve member assembly, namely, atmospheric pressure pushing the assembly downward, the absolute pressure of the $CO_2$ cartridge 66 pushing the valve closure member 100 downward, and the absolute pressure in the soft drink bottle pushing the assembly upward. Relating these forces to gauge pressure, the forces are reduced to two, namely, the $CO_2$ gauge pressure pushing the valve closure member 100 downward, and the gauge pressure in the soft drink container pushing the entire assembly upward. In the preferred embodiment, the effective diameter of valve seat 90 is slightly larger than 0.03 inches, with the diameter of opening 78 and of member 94 therein being approximately 0.375 inches. With a carbon dioxide pressure in cartridge 66 of approximately 1,000 PSI, member 94 will be forced upward to cause the valve closure member 100 to seal off the valve seat 90 when the pressure in the soft drink container 20 is on the order of 10 PSI. In that regard, the carbon dioxide cartridges contain liquid carbon dioxide, at least until almost entirely exhausted of carbon dioxide, with the result that the pressure therein does not depend upon the amount of liquid carbon dioxide left therein. Thus the pressure balance for closure of the regulator valve will not vary until all liquid carbon dioxide in the cartridge 66 is exhausted. While the pressure will vary with the temperature of the cartridge 66, that variation will be less than a two to one variation between typical refrigerator temperatures and relatively hot outdoor temperatures, which variation will not significantly effect the operation of the dispenser. In that regard, if for some reason the pressure regulator fails to fully close and carbon dioxide continues to leak into the soft drink container 20, raising the pressure therein above an acceptable operating level, such pressure will force the ball 108 of the relief valve off of seat 102, venting the excess pressure through the opening 102 and opening 110 to prevent the pressure within the soft drink container 20 from reaching an unsafe level. Finally, of course, if for some reason this too either fails to work or is inadequate to sufficiently relieve the increasing pressure, the dispensing valve will also blow open at a somewhat higher pressure as a further safety measure.

There has been disclosed and described herein a new and unique soft drink dispenser incorporating a particularly low cost dispensing system and valve, designed to minimize foaming in the dispensed carbonated soft drink, and at the same time to provide a pressure relief capability in the event of failure of both the pressure regulator and the primary pressure relief valve. The pressure regulator on the other hand is also of particularly simple construction, readily assembled as an assembly integral with the main body member of the dispenser In the preferred embodiment, the pressure regulator parts are molded from a PC-PET blend supplied by Mobay as their Microblend 1018, with the rest of the hard plastic parts being ABS. Of course, while the preferred embodiment of the present invention has been disclosed and described herein, it will be understood by those skilled in the art that various changes in form and detail may be made therein without departing from the spirit and scope of the invention.

We claim:

1. A portable dispenser for maintaining carbonation in and dispensing carbonated drinks from carbonated beverage containers comprising:

a dispenser body assembly including means for sealably coupling to the open top of a beverage container;

cartridge holding means for retaining a source of $CO_2$ to said dispenser body assembly;

said dispenser body assembly including pressure regulating means in said body assembly for regulating the flow of $CO_2$ from a $CO_2$ cartridge in said cartridge holding means to a beverage container coupled thereto to maintain $CO_2$ pressure in the beverage container, said pressure regulating means having;

a first opening in said dispenser body assembly extending therethrough within the means for sealably coupling to the open top of a beverage container;

a second opening in said dispenser body means communicating between said cartridge holding means and said first opening;

communication means within said second opening and extending into said first opening to define a valve seat facing said means for sealably coupling to the top of beverage container, said communication means being a means for communicating $CO_2$ in a $CO_2$ cartridge in said cartridge holding means to said valve seat; and regulator means within said first opening in said dispenser body means and sealably movable with respect thereto in response to forces thereon, said regulator means having a portion thereof reaching around the portion of said communication means extending into said first opening to define a valve closure member between said valve seat and said means for sealably coupling to the open top of a beverage container, said regulator means being a means for controlling the flow of $CO_2$ into a beverage container coupled to said dispenser body assembly responsive to the approximate force balance between the pressure in a beverage container encouraging said regulator means in a direction to encourage said valve closure member against said valve seat, and the pressure in a $CO_2$ cartridge as communicated to said valve seat encouraging said valve closure member away from said valve seat;

tube means having first and second ends and being supported in and sealed with respect to said dispenser body assembly, said tube means extending through said body assembly by a predetermined distance in the region of said means for coupling to the open top of a container, whereby said first end of said tube means will be adjacent to the bottom of a beverage container to which said body assembly may be coupled, said tube means being curved within said body assembly through an angle exceeding 90 degrees without any sharp bends therein, said second end of said tube means being disposed adjacent a complimentary opening in said body assembly therefor, whereby said second end of said tube means will project downward as a dispensing spout when said body assembly is coupled to an upright beverage container, said tube means having a substantially uniform first inner diameter for at least most of its length, said tube means being free of any step changes in its inner diameter, said tube means being flexible at least adjacent said second end thereof;

a dispensing lever means supported on said dispenser body assembly and rotatable between a closed position engaging said tube means adjacent said second end thereof and pinching the same against a cooperative surface of said dispenser body assembly to prevent flow therethrough, and an open position not pinching said tube means to allow free flow therethrough; and, spring means for yieldably encouraging said dispensing lever means to said closed position.

2. The portable dispenser of claim 1 wherein said regulator means has a pressure relief means therein for relieving excess pressure in a beverage container coupled to said dispenser body assembly.

3. A portable dispenser for maintaining carbonation in and dispensing carbonated drinks from carbonated beverage containers comprising:

a dispenser body assembly including means for sealably coupling to the open top of a beverage container;

cartridge holding means for retaining a source of $CO_2$ to said dispenser body assembly;

said dispenser body assembly including pressure regulating means in said body assembly for regulating the flow of $CO_2$ from a $CO_2$ cartridge in said cartridge holding means to a beverage container coupled thereto to maintain $CO_2$ pressure in the beverage container, said pressure regulating means having;

a first opening in said dispenser body assembly extending therethrough within the means for sealably coupling to the open top of a beverage container;

a second opening in said dispenser body means communicating between said cartridge holding means and said first opening;

communication means within said second opening and extending into said first opening to define a valve seat facing said means for sealably coupling to the top of beverage container, said communication means being a means for communicating $CO_2$ in a $CO_2$ cartridge in said cartridge holding means to said valve seat;

regulator means within said first opening in said dispenser body means and sealably movable with respect thereto in response to forces thereon, said regulator means having a portion thereof reaching around the portion of said communication means extending into said first opening to define a valve closure member between said valve seat and said means for sealably coupling to the open top of a beverage container, said regulator means being a means for controlling the flow of $CO_2$ into a beverage container coupled to said dispenser body assembly responsive to the approximate force balance between the pressure in a beverage container encouraging said regulator means in a direction to encourage said valve closure member against said valve seat, and the pressure in a $CO_2$ cartridge as communicated to said valve seat encouraging said valve closure member away from said valve seat;

tube means having first and second end and being supported in and sealed with respect to said dispenser body assembly, said tube means extending through said body assembly by a predetermined distance in the region of said means for coupling to the open top of a container, whereby said first end of said tube means will be adjacent to the bottom of a beverage container to which said body assembly may be coupled, said tube means being curved within said body assembly through an angle exceeding 90 degrees without any sharp bends therein, said second end of said tube means being disposed adjacent a complimentary opening in said body assembly therefor, whereby said second end of said tube means will project downward as a dispensing spout when said body assembly is coupled to an upright beverage container, said tube means having a substantially uniform first inner diameter for at least most of its length, and inner diameters throughout the rest of its length of not less than said first inner diameter, said tube means being free of any step changes in its inner diameter, said tube means being flexible at least adjacent said second end thereof;

a dispensing lever means supported on said dispenser body assembly and rotatable between a closed position engaging said tube means adjacent said second end thereof and pinching the same against a cooperative surface of said dispenser body assembly to prevent flow therethrough, and an open position not pinching said tube means to allow free flow therethrough; and spring means for yieldably encouraging said dispensing lever means to said closed position.

4. The portable dispenser of claim 3 wherein said regulator means has a pressure relief means therein for relieving excess pressure in a beverage container coupled to said dispenser body assembly.

5. A portable dispenser for maintaining carbonation in and dispensing carbonated drinks from carbonated beverage containers comprising:

a dispenser body assembly including means for sealably coupling to the open top of a beverage container;

dispensing means in said dispenser body assembly, including tube means for extending into a beverage container that may be coupled thereto, for controllably allowing pressure in a beverage container that may be coupled thereto to force a carbonated drink to be dispensed from the container and portable dispenser cartridge holding means for retaining a source of $CO_2$ to said dispenser body assembly; and said dispenser body assembly including pressure regulating means in said body assembly for regulating the flow of $CO_2$ from a $CO_2$ cartridge in said cartridge holding means to a beverage container coupled thereto to maintain $CO_2$ pressure in the beverage container, said pressure regulating means having;

a first opening in said dispenser body assembly extending therethrough within the means for sealably coupling to the open top of a beverage container;

a second opening in said dispenser body means communicating between said cartridge holding means and said first opening;

communication means within said second opening and extending into said first opening to define a valve seat facing said means for sealably coupling to the top of beverage container, said communication means being a means for communicating $CO_2$ cartridge in said cartridge holding means to said valve seat, and regulator means within said first opening in said dispenser body means and sealably movable with respect thereto in response to forces thereon, said regulator means having a portion thereof reaching around the portion of said communication means extending into said first opening to define a valve closure member between said valve seat and said means for sealably coupling to the open top of a beverage container, said regulator means being a means for controlling the flow of $CO_2$ into a beverage container coupled to said dispenser body assembly responsive to the approximate force balance between the pressure in a beverage container encouraging said regulator means in a direction to encourage said valve closure member against said valve seat, and the pressure in a $CO_2$ cartridge as communicated to said valve seat encouraging said valve closure member away from said valve seat.

6. A pressure regulator comprising:

a regulator body having an inlet connection means for connecting to a source of fluid under a first pressure and an outlet connection means for connecting to an outlet to which fluid is to be delivered to maintain the pressure therein at a second regulated pressure less than said first pressure;

a first opening in said regulator body extending therethrough in fluid communication with said outlet connection means;

a second opening in said regulator body communicating between said inlet connection means and said first opening;

communication means within said second opening and extending into said first opening to define a valve seat facing said outlet connection means, said communication means being a means for communicating fluid from said inlet connection means to said valve seat, and pressure regulator means within said first opening in said regulator body and sealably movable with respect thereto in response to forces thereon, said pressure regulator means having a portion thereof reaching around the portion of said communication means extending into said first opening to define a valve closure member between said valve seat and said outlet connection means, said pressure regulator means being a means for controlling the flow of fluid from said inlet connection means to said outlet connection means responsive to the approximate force balance between the pressure in said outlet communication means encouraging said pressure regulator means in a direction to encourage said valve closure member against said valve seat, and the pressure in said inlet communication means as communicated to said valve seat encouraging said valve closure member away from said valve seat.

7. The regulator of claim 6 wherein said pressure regulator means has a pressure relief means therein for relieving excess pressure in said outlet connection means.

* * * * *